United States Patent [19]

Meyer et al.

[11] Patent Number: 4,856,205

[45] Date of Patent: Aug. 15, 1989

[54] AIR GUIDE BOX FOR THE DRYING SECTION OF A HIGH-SPEED PAPER MACHINE

[75] Inventors: Richard Meyer, Frickingen; Wolfgang Müller, Giegen; Helmut Heinzmann, Böhmenkirch, all of Fed. Rep. of Germany

[73] Assignee: J. M. GmbH Voith, Heidenheim, Fed. Rep. of Germany

[21] Appl. No.: 162,114

[22] Filed: Feb. 29, 1988

[30] Foreign Application Priority Data

Feb. 28, 1987 [DE] Fed. Rep. of Germany ..... 3706542

[51] Int. Cl.[4] ..... F26B 13/04

[52] U.S. Cl. ..... 34/117; 34/120

[58] Field of Search .....34/117, 120, 123, 161, 34/157, 159, 114, 122

[56] References Cited

U.S. PATENT DOCUMENTS

| | | | |
|---|---|---|---|
| 3,587,177 | 6/1971 | Overly . | |
| 4,185,399 | 1/1980 | Gladish | 34/120 |
| 4,441,263 | 4/1984 | Vedenpää . | |
| 4,502,231 | 3/1985 | Fissmann et al. | 34/117 X |
| 4,551,203 | 11/1985 | Eskelinen . | |
| 4,628,618 | 12/1986 | Virta et al. . | |
| 4,669,198 | 6/1987 | Wedel | 34/117 X |
| 4,716,660 | 1/1988 | Thiele | 34/114 |

*Primary Examiner*—Henry A. Bennett

*Attorney, Agent, or Firm*—Albert L. Jeffers; Richard L. Robinson

[57] ABSTRACT

Air guide box 20 for a paper machine where the paper web 16 to be dried runs together with the backing belt 18 across drying cylinders 10 through 14. The air guide box 20 extends from a point A where the backing belt 18 departs from a cylinder 10, 12 toward a point Z where the backing belt runs on the following cylinder 11, 13. A diverging gap 23 remains between the air guide box 20 and the backing belt 18. The air guide box 20 has in the area of the departure point A a mechanical air boundary layer stripper 25. Facing toward the backing belt 18 and diverging in its running direction from the contact screen, the wall 21 of the air guide box 20 is shaped in accordance with the operationally occurring curved trajectory of the contact screen 18, is composed, preferably in polygon fashion, from flat wall elements 21.1, 21.2 and 21.3.

17 Claims, 2 Drawing Sheets

α
25
24
A
41
40
21.1
30
20
10, 12
17
21.2
21
23
I
R
21.3
35
37
34
27
33
31
29
26
11, 13
32
22
42
16
18
Z

AIR GUIDE BOX FOR THE DRYING SECTION OF A HIGH-SPEED PAPER MACHINE

BACKGROUND OF THE INVENTION

The present invention concerns an air guide box for the drying section of a high-speed paper machine where the paper web to be dried meanders together with a backing belt forming a continuous backing belt loop across drying cylinders, and at that, alternately across drying cylinders that are located outside and inside the backing belt loop. An air guide box of the categorial type is known from the German patent document No. 32 36 576 which is equivalent to U.S. Pat. No. 4,502,231.

In a drying section using such air guide boxes, as is generally known, the drying cylinders are arranged in two tiered rows. The paper web and a continuous backing belt run alternately across cylinders of an upper and a lower row. The cylinders arranged in the one row, preferably the top row, are contained outside the continuous backing belt loop, whereas the cylinders of the other row, preferably the bottom row, are arranged within the continuous backing belt loop. The air guide box is always arranged on a backing belt section running from an outside (preferably top) to an inside (preferably bottom) cylinder.

The expression "cylinder" respectively "drying cylinder" is to be understood here quite generally, i.e., it covers not only steam-heated drying cylinders with a smooth cylinder surface but also guide rolls with a smooth, profiled or perforated surface which, when needed, may be fashioned as suction rolls. This is because the inventional air guide box is suitable for drying sections of various designs. In a preferable design, both the outside and inside cylinders are fashioned as steam-heated drying cylinders. In another preferred drying section design, only the outside cylinders are fashioned as steam-heating drying cylinders, whereas the inside cylinders, i.e., preferably those of the bottom row, are designed as guide rolls or as suction guide rolls.

Forces of various types act in the drying section of a high-speed paper machine on the paper web and the backing belt; as the paper web and the backing belt pass through the paper machine, these forces cause at increasing speed phenomena such as web flutter, web liftoff and wrinkling. These phenomena, which possibly may even lead to a break of the paper web, are to be avoided as much as possible.

This objective was extensively accomplished already with the air guide box according to the German patent document No. 32 36 576, which is known also by the name "web stabilizer". But specific examinations of the air flows, for one, and practical experience, for another, have shown that the prior air guide box can be optimized further in view of the requirements imposed on it.

In the practical operation of high-speed paper machines using air guide boxes according to the German patent document No. 32 36 576, the following was noticed at increasing machine speeds: There is a risk that the backing belt, which together with the paper web meanders across the drying cylinders, will at times brush against the air guide box. Such a contact occurs specifically on the so-called boundary layer stripper arranged on the entrance (preferably upper) end of the first box wall (also called "foil wall"). But an undesirable contact with the backing belt may occur also on the foil wall. Attempts were made at circumventing these problems by adjusting a greater space between the trajectory of the backing belt and the foil wall. But this approach was not satisfactory either because it invited the risk that—at least at times—the foil effect is lost, i.e., that an appreciable vacuum is no longer created in the gap between the backing belt and the air guide box.

Considered also was a replacement of the mechanical boundary layer stripper by a blowing air jet (air scraper) directed at the backing belt; refer to column 6, lines 14 and 15, of the German patent document No. 32 36 576. But this has the disadvantage that the consumption of blowing air increases considerably. Besides, there is the risk that the blowing air jet directed at the backing belt will penetrate the backing belt and cause the paper web to lift off the backing belt. But the objective is exactly the opposite, namely causing the paper web to safely adhere to the backing belt.

Previously known is an arrangement such that the entrance edge of the foil wall of the air guide box, on which the boundary layer stripper is mounted, is arranged in the area where the backing belt separates from the upper cylinder. This arrangement would result in the case of the prior air guide box when the vertical distance between the upper cylinder row and the lower cylinder row is smaller than illustrated in the German patent document No. 32 36 576. Such an arrangement, in principle, is known already in the case of a large vertical cylinder spacing. The length of the air guide box—viewed in cross-section—is in this case enlarged accordingly. But this increases also the risk of a contact between the backing belt and the foil wall of the air guide box and, thus, the risk of wear on these elements.

The problem underlying the present invention is therefore to so modify the design of the prior air guide box that the risk of wear is eliminated or at least reduced on the backing belt and on the air guide box itself, which is in no way to adversely affect the stability of the run of the paper web in contact with the backing belt, but rather to improve it further, thereby enabling in the future machine speeds that are higher yet than heretofore. This problem is solved by the present invention.

In other words, this means that the so-called foil wall of the air guide box is no longer of flat design such as before, but is adapted to the curved course of the backing belt that adjusts itself operationally. This adaptation is to be such that now as before (i.e., despite the curved course of the backing belt) the gap between the backing belt and the air guide box diverges gradually in the running direction of the backing belt, thereby ensuring the foil effect of the air guide box across its entire length, viewed in cross-section.

The inventional design takes into account that the course of the backing belt and the paper web deviate more or less from the theoretical, straight running course tangent to the two cylinder surfaces as the machine speed increases, with said course more or less bowing out toward the air guide box. The adaptation of the foil wall to this bow-out ensures that the backing belt and the foil wall will not make contact even at high machine speeds and that the entrance and edge of the foil wall—despite a large vertical cylinder spacing (and thus a great length of the air guide box—viewed in cross-section) —can be arranged at the point where the paper web and the backing belt are still in contact with the upper cylinder. In other words, the entrance end edge of the foil wall can be safely arranged in the area of the departure point of the backing belt from the upper cylinder and even before it (relative to the running direction). This latter variant will be explained below.

Thus, it is inventionally possible to always make use of the possibility of adjusting between the entrance end, on which now as before a boundary layer stripper is arranged, and the backing belt an exactly definable small spacing. This makes it possible for the boundary layer stripper to preferably work in noncontact fashion. This is true not only for the case when the boundary layer stripper is fashioned as a blowing air jet (air scraper), but it applies specifically also in the preferred case where a mechanical boundary layer stripper is concerned (felt strip, brush slat or similar). This eliminates also the risk that the seam that makes the backing belt continuous and is thicker than the backing belt itself will make contact with the boundary layer stripper. Additionally, there is now always the previously known advantage that the effect of the air guide box, namely the creation of a vacuum in the gap between the backing belt and the air guide box, begins already at the point where the paper web and the backing belt depart from the upper drying cylinder. This counteracts the tendency of the paper web to continue, at the departure point, clinging for a short distance to the cylinder surface of the drying cylinder and only then settle again on the backing belt.

As already indicated though, the boundary layer stripper need not be arranged exactly at the departure point of the backing belt from the upper drying cylinder. Rather, the invention makes it possible to extend the air guide box somewhat further upward so that the boundary layer stripper is situated within the so-called looping zone in which the paper web and the backing belt touch the curved cylinder surface of the upper drying cylinder. This is advantageous because stripping the boundary air layer carried by the backing belt is more effective in this area. This utilizes the phenomenon that a vacuum is created in the radially inner area of an air boundary layer proceeding along a curved course, so that the air in the radially inner partial layer is thinner than in the radially outer partial layers.

BRIEF DESCRIPTION OF THE DRAWINGS

The invention will be more fully explained hereafter with the aid of the drawing.

DESCRIPTION OF THE PREFERRED EMBODIMENT

Figure 1:
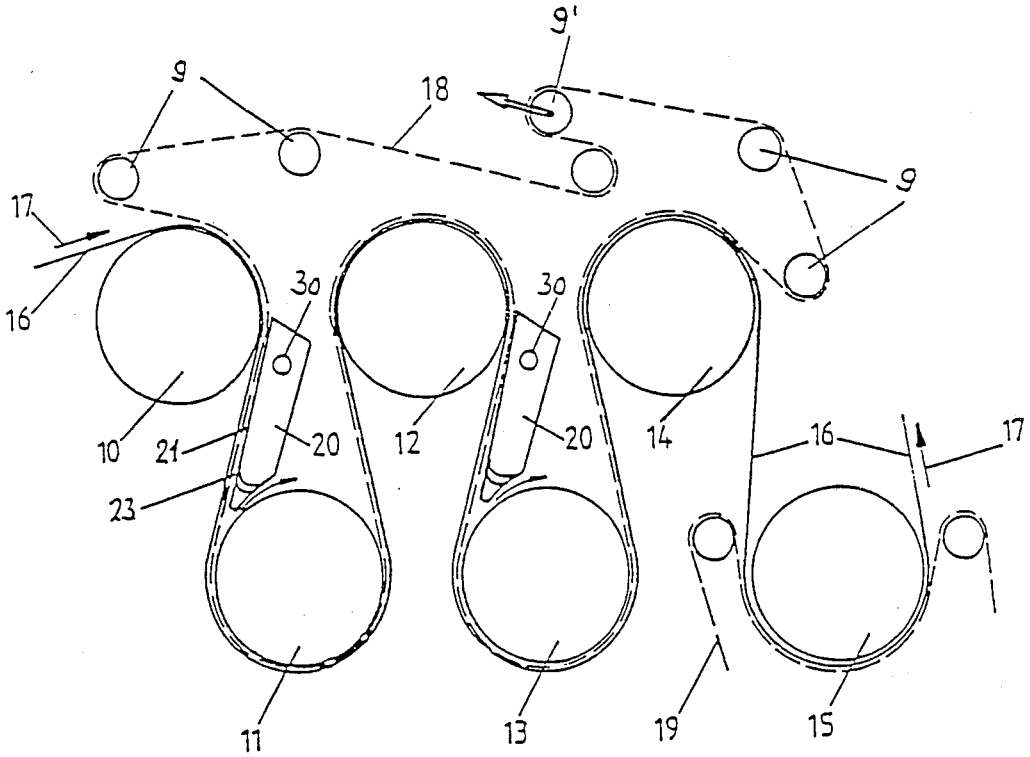
FIG. 1 shows schematically a section of a drying section of a paper machine.

The five drying cylinders 10 through 14 illustrated in FIG. 1 form a drying group of a drying section. Another drying cylinder, marked 15, is an integral part of a subsequent drying group. The drying cylinders 10, 12 and 14 are arranged in an upper row, the cylinders 11 13 and 16 in a bottom row. The paper web 16 to be dried meanders in the direction of arrows 17 across the drying cylinders. Within the first drying group 10 through 14, the web is constantly accompanied by the continuous, air-permeable backing belt (drying screen) 18, which from the cylinder 14 returns again to the first cylinder 10 via guide rolls 9. The drying cylinders 10, 12 and 14 of the top row are situated outside the loop formed by the backing belt 18, whereas the cylinders 11 and 13 of the bottom row are situated within the loop. The paper web 16 extends thereby in the area of the upper cylinders 10, 12 and 14 between their cylinder surfaces and the backing belt 18. In the area of the bottom cylinders 11 and 13, conversely, the paper web 16 is located on the outside of the backing belt 18 bearing on these cylinders. On the free sections between the cylinders 12 through 14, the paper web 16 is supported by the backing belt 18. A free paper train exists for the first time between the cylinders 14 and 15. In the following drying groups, each cylinder row has a backing belt 19 of its own.

Provided on the common course of the paper web 16 and the backing belt 18, from one of the upper drying cylinders 10 respectively 12 to one of the lower cylinders 11 respectively 13, is an air guide box 20 each, on the side of the backing belt. Rigid and having a length equal to the web width or less, each of the air guide boxes 20 extends transverse to the drying section. Shorter air guide boxes are preferably arranged in the marginal areas of the paper web.

True for all embodiments is that the air guide box with the illustrated cross-sectional shape extends normally crosswise through the entire drying section, that is, from the backing belt edge on the tending side to that of the drive side and still somewhat farther beyond these edges. But it is also possible to provide two relatively short air guide boxes only in the area of the two edges, since it may at times be sufficient to suck only the paper web edges to the backing belt.

An air guide box 20 is described hereafter in more detail. Essentially closed on all sides, the air guide box 20 has a first wall 21 which hereafter will be referred to as foil wall and which, viewed in the cross-section of the air guide box 20, extends along the backing belt 18 up to the inlet gore formed by it and the free cylinder surface of the lower drying cylinder 11 respectively 13. This leaves between the foil wall 21 and the backing belt 18 a gap 23 that diverges toward the inlet gore.

The air guide box described thus far is the object of the German patent document No. 32 36 576. Different from it, the air guide box according to the present invention extends considerably farther in the direction toward the upper half of the cylinder surface of the respective upper drying cylinder 10 respectively 12, and the foil wall 21 is with regard to the divergence of the gap 23 of the real web curve designed accordingly.

Figure 2:
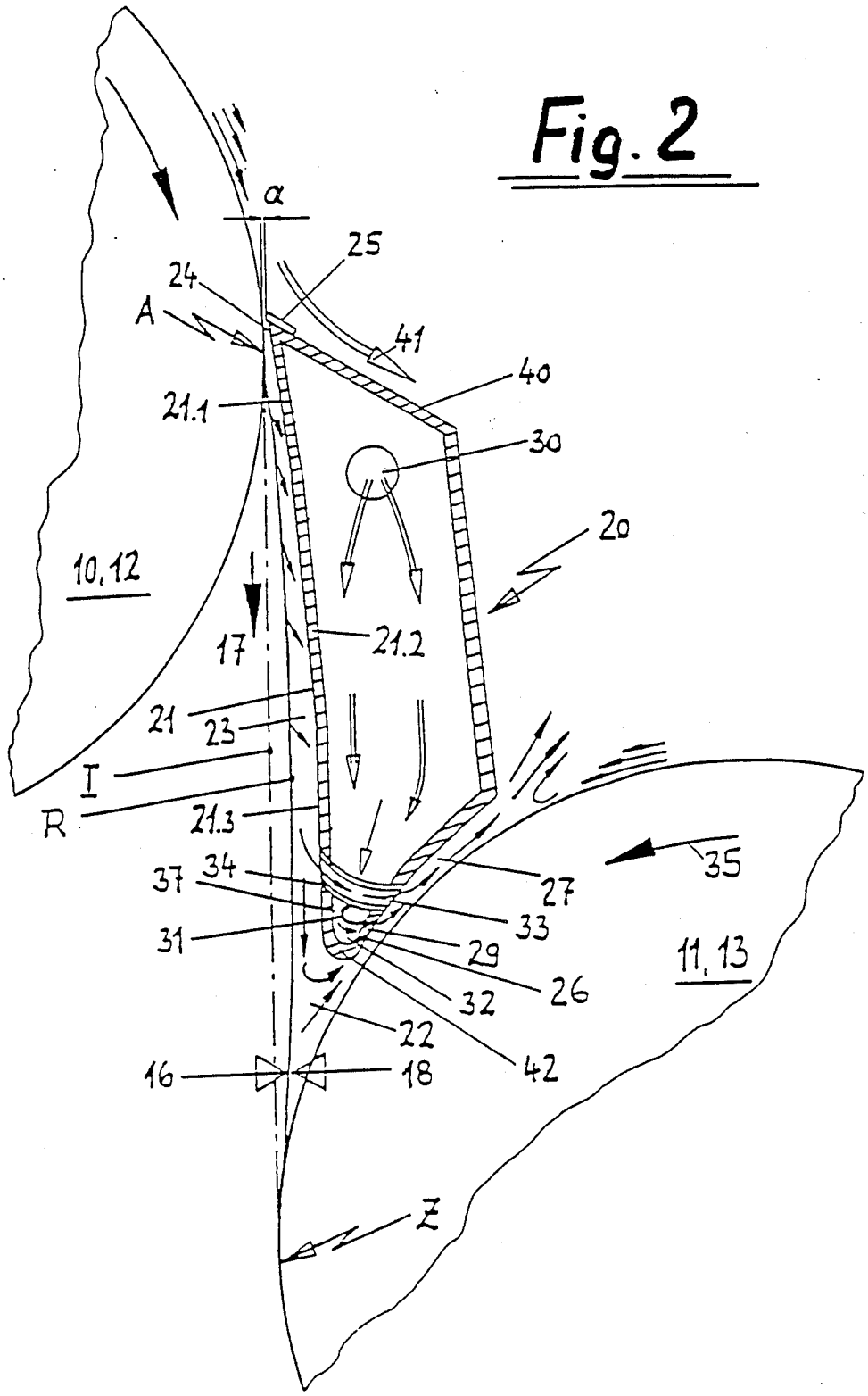
FIG. 2 shows an inventional air guide box, in cross-section and scaled up relative to FIG. 1.

This air guide box 20 will be more fully described with the aid of FIG. 2. Illustrated in FIG. 2 are an upper drying cylinder 10, 12 and a lower drying cylinder 11, 13. The paper web 16 and the backing belt 18 separate from the upper drying cylinder 10, 12 and run to the lower drying cylinder 11, 13. On condition of a low speed and proper backing belt tension, the paper web 16 and the backing belt 18 would each respectively approach tangentially along an ideal curve I. Due to, e.g., dead weight and centrifugal forces and due to the vacuum created between the backing belt 18 and the air guide box 20 though, this trajectory bows out toward the air guide box 20.

The extent of this bow-out is determined, among others, by the longitudinal tension which is present in the backing belt 18, which customarily can be adjusted by means of a tensioning roll 9' (see FIG. 1). At any rate, an arcuate (real) trajectory R occurs between the upper 10, 12 and lower drying cylinders 11, 13. This real trajectory R, in the final analysis, corresponds to the shape of the paper web 16 and the backing belt 18 enroute from the delivering cylinder 10, 12 to the receiving cylinder 11, 13 and the foil wall 21 of the air guide box is adapted approximately to this trajectory R, and at that, with the proviso that the gap 23 between the trajectory R and the departure point A from the delivering cylinder 10, 12 to the approach point Z of the receiving cylinder 11, 13 diverges, and thus increases across the length of the first wall.

According to the illustration in FIG. 2, the gap 23 is realized by a polygonal design of the foil wall 21. In a first area 21.1 bordering on the departure point A, the foil wall 21 extends about parallel to the trajectory R; in a second, subsequent area 21.2, the foil wall 21 extends, viewed in the running direction 17, under conical divergence relative to the trajectory R; and in a third area 21.3 the foil wall 21 extends again approximately parallel with the trajectory R. Due to this diverging gap 23, the above mentioned vacuum is generated across the entire length of the foil wall 21, favoring the adhesion between the paper wall 16 and the air-permeable backing belt 18.

The air guide box 20 as a whole, in detail, is designed as follows. Arranged on the upper edge 24 of the foil wall 21 is a boundary layer stripper 25 which extends toward the backing belt 18. Consisting of a felt strip or a plastic brush or also a so-called air scraper, this boundary layer stripper 25 extends close (space a of about 2 mm) to the free surface of the backing belt 18 and provides noncontact stripping of the air boundary layer carried by the belt. To avoid backups in the area of the boundary layer stripper 25, the invention provides for setting the wall 40 of the air guide box bordering in this area on the foil wall 21 at an acute angle. This makes for an easier separating sweep of the air (arrow 41).

Additionally, the air guide box 20 has a second wall 26 which, forming a gap 27 relative to the cylinder surface of the lower drying cylinder 11 respectively 13, meets in the area of the inlet gore 22 with the foil wall 21. Provided there is an aerodynamic rounding 42, from the foil wall 21 to the second wall 26. As compared with the air guide box according to the German patent document No. 32 36 576, the air flowing through the gap 23 toward the inlet gore 22 can transfer to the gap 27 on the cylinder side along a path shorter than before (and thus with lower flow losses).

Second wall 26, in its area on the gore end, features a slot-shaped opening 29 for the discharge of air. This opening 29 extends in the longitudinal direction of the air guide box 20. Facultatively, the opening 29 is bridged by spaced connecting strips so as to secure in the case of very long air guide boxes 20 the stability of the sections of the second wall 26 which are located on both sides of the opening. As can be seen in FIG. 2, the blowing direction of the opening 29 extends at an acute angle to the second wall 26 and essentially opposite to the running direction 35 of the cylinder 11, 13.

The air guide box 20 is connected, on its end, to a blowing air line 30. Located inside the air guide box 20, in the path of the blowing air flow from the feed line 30 to the slot-shaped opening 29, is a baffle 31. This latter extends across the entire box length and defines, together with the second wall 26, a cross-sectionally nozzle-shaped space 32 that extends into the slot-shaped opening 29. Additionally, a curved channel 33 may be provided between the foil wall 21 and the second wall 26, connecting the gap 23 on the backing belt side and the gap 27 on the cylinder side with each other. The curvature of this channel is such that it extends, viewed in the running direction 17, at an acute angle to the trajectory R and at an acute angle to the surface of the lower drying cylinder 11, 13. The channel 33—so as not to prevent the flow of blowing air from the feed line 30 to the slot-shaped opening 29—is designed as a number of curved pipes 34 extending in the longitudinal direction of the air guide box 20. The end of the channel 33, on the backing belt side, is located in the bottom third of the foil wall 21. Viewed in the running direction (arrow 35) of the lower drying cylinder 11 respectively 13, the mouth of the channel 33 on the cylinder side is located closely before the slot-shaped opening 29. The second wall 26 diverges from the lower drying cylinder 11, 13 so that the gap 27 undergoes opposite to the running direction of the lower drying cylinder 11, 13 (arrow 35) a widening which favors the flow conditions.

The flow conditions prevailing around the air guide box 20 and in the air guide box itself present themselves as follows. The blowing air proceeding to the air guide box 20 negotiates on its way to the slot-shaped opening a choke gap 37 which is defined by the foil wall 21 and the baffle 31 and which causes the pressure of the air to be evenly distributed across the length of the air guide box 20. In the nozzle-shaped space 32, the blowing air undergoes an acceleration so that it enters the gap 27 at high speed and opposite to the running direction (arrow 35) of the lower drying cylinder 11 respectively 13. In the course of its flow path through the gap 27 on the cylinder side, the blowing air stripe the air boundary layer that is carried by the lower drying cylinder 11, 13 and prevents it from being carried into the inlet gore 22.

The boundary layer stripper 25 on the entrance side edge 24 of the foil wall 21 deflects a considerable part of the air boundary layer from the backing belt 18 across the mentioned wall 40. Due to the previously described divergence of the gap 23 on the backing belt side toward the inlet gore 22, a vacuum is created in this gap 23 (and thus the so-called "foil effect"). This vacuum tends to equalize itself by sucking air through the backing belt 18, causing the intended settling of the paper web 16 on the backing belt 18. Additionally, a considerable increase of the vacuum occurs yet on account of the ejector effect of the blowing air in the gap 27 on the cylinder side. This is because air is siphoned off both from the inlet gore 22 and through the channel 33 from the gap 23 on the backing belt side, by this blowing air. In this respect, reference is made explicitly to the illustration in FIG. 2, where the arrows show clearly the air flows described.

Figure 3:
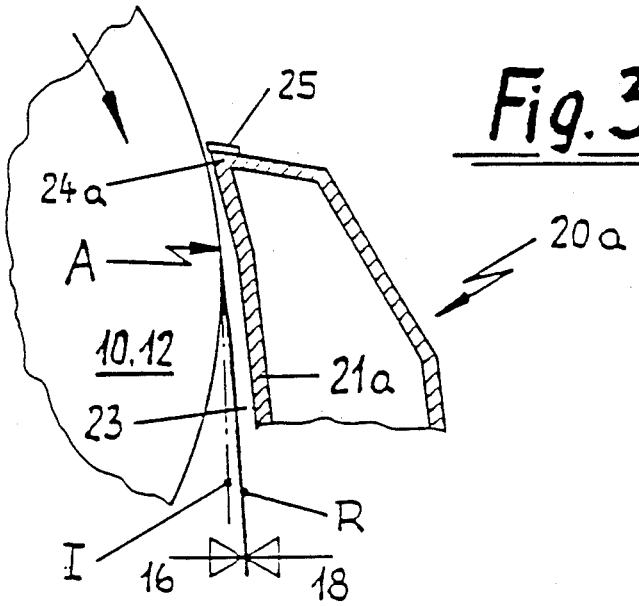
FIG. 3 shows a partial cross-section of an embodiment differing from FIG. 2.

Illustrated in the embodiment according to FIG. 3 is an air guide box **20*a* where the upper edge 24*a* of the foil wall 21*a* with the boundary layer stripper 25 is located above the departure point A of the backing belt 18 from the upper cylinder 10, 12. The boundary layer stripper 25 is thus located within the looping zone of the paper web 16 and backing belt 18**, thereby favoring the stripping of the air boundary layer.

What is claimed is:

1. An air guide box for the drying section of a high-speed paper machine in which a paper web to be dried meanders in a running direction together with a backing belt configured as a continuous backing belt loop alternately across drying cylinders located outside and inside the backing belt loop, characterized by:

said air guide box extending along a side of said backing belt not covered by the paper web from proximate a departure point where the paper web and backing belt depart from an outside drying cylinder toward an inlet gore located proximate an approach point where the backing belt and paper web run onto a following inside drying cylinder;

said air guide box having a first foil wall which viewed in cross-section extends from an edge on an approach side along the backing belt toward said inlet gore, leaving between the foil wall and the backing belt a first gap which diverges in the running direction of the backing belt;

said air guide box having a second wall located proximate the cylinder surface of said following inside drying cylinder and together there with defines a second gap, said second wall meeting said foil wall in said inlet gore;

said second wall being provided with an air blowing slot proximate the inlet gore having a blowing direction opposite to the running direction of the cylinder surface of said following inside drying cylinder;

a device for stripping the air boundary layer carried by the backing belt provided on said edge of the foil wall on said approach side; and said foil wall being shaped so as to correspond with the trajectory of the backing belt which, in operation, curves toward the foil wall between said outside drying cylinder and said following inside drying cylinder.

2. An air guide box according to claim 1, in which a common edge between the foil wall and the second wall extends at a relatively large spacing from the approach point where the backing belt and the paper web run onto said following inside cylinder.

3. An air guide box according to claim 1, in which a common edge between the foil wall and the second wall is rounded.

4. An air guide box according to claim 1, in which the foil wall is composed of adjoining flat wall elements defining, in cross-section, a foil wall of polygonal design.

5. An air guide box according to claim 1, in which the device for stripping the air boundary layer is a mechanical stripper and a gap of about 2 mm is provided between the backing belt and the mechanical stripper.

6. An air guide box according to claim 1, in which the device for stripping the air boundary layer is an air scraper.

7. An air guide box according to claim 1, in which said edge of the foil wall on said approach side, supporting the device for stripping the air boundary layer is arranged, as regards the running direction of the support belt, before the departure point of the backing belt from the outside drying cylinder.

8. An air guide box according to claim 1, in which the air guide box includes a third wall bordering on the foil wall on said approach side arranged at an acute angle to the surface of the outside drying cylinder.

9. An air guide box according to claim 1, including a channel originating from the foil wall and extending through the second wall and providing passage of air from the first diverging gap on the backing belt side, said channel emptying in the second gap on the cylinder side, the channel viewed in the running direction of the inside drying cylinder ending before the air blowing slot at the second gap on the cylinder side, the channel being of a curved design and extending at an acute angle to the first gap and to the second gap.

10. An air guide box according to claim 9, in which the channel is formed by curved pipes.

11. An air guide box according to claim 2, in which a common edge between the foil wall and the second wall is rounded.

12. An air guide box according to claim 11, in which the foil wall is composed of adjoining flat wall elements defining, in cross-section, a foil wall of polygonal design.

13. An air guide box according to claim 12, in which the device for stripping the air boundary layer is a mechanical stripper and a gap of about 2 mm is provided between the backing belt and the mechanical stripper.

14. An air guide box according to claim 13, in which said edge of the foil wall on said approach side supporting the device for stripping the air boundary layer, is arranged, as regards the running direction of the support belt, before the departure point of the backing belt from the outside drying cylinder.

15. An air guide box according to claim 14, in which the air guide box includes a third wall bordering on the foil wall on said approach side arranged at an acute angle to the surface of the outside drying cylinder.

16. An air guide box according to claim 15, including a channel originating from the foil wall and extending through the second wall and providing passage of air from the first diverging gap on the backing belt side, said channel emptying in the second gap on the cylinder side, the channel viewed in the running direction of the inside drying cylinder ending before the air blowing slot at the second gap on the cylinder side, the channel being of a curved design and extending at an acute angle to the first gap and the second gap.

17. An air guide box according to claim 16, in which the channel is formed by curved pipes.

* * * * *